US007357662B1

(12) United States Patent
Huang

(10) Patent No.: US 7,357,662 B1
(45) Date of Patent: Apr. 15, 2008

(54) ELECTRIC TERMINAL CONNECTOR

(76) Inventor: Jui-Lin Huang, 4F, No. 210, Desian Rd., Nanzih District, Kaohsiung City (TW)

( * ) Notice: Subject to any disclaimer, the term of this patent is extended or adjusted under 35 U.S.C. 154(b) by 0 days.

(21) Appl. No.: 11/766,384

(22) Filed: Jun. 21, 2007

(51) Int. Cl.
*H01R 4/24* (2006.01)

(52) U.S. Cl. ..... 439/441; 439/259; 439/263

(58) Field of Classification Search ..... 439/436–441, 439/259, 263
See application file for complete search history.

(56) References Cited

U.S. PATENT DOCUMENTS 5,104,338 A * 4/1992 Mitra ..... 439/495
6,783,385 B2 * 8/2004 Rudy ..... 439/438

* cited by examiner

*Primary Examiner*—Tho D. Ta
(74) *Attorney, Agent, or Firm*—Alan Kamrath; Kamrath & Associates PA

(57) ABSTRACT

An electric terminal connector includes a shell, a bridge unit, and a cap. The shell has a compartment a first end, a second end and at least one biasing member. The bridge unit is received in the compartment of the shell, which has a base and at least one elastic reed. The base securely mounted in the compartment, and the at least one elastic reed fastened on the base and extending to an area adjacent to the at least one biasing member respectively. The cap forms a passageway, covers the first end of the shell, and presses the biasing member to protrude into the compartment of the shell to bias the elastic reed. Consequently, at least one transmission line passes through the passageway of the cap and is securely fastened between and electrically connects with the biased elastic reed and the base, with a coax connector combining with the shell at the second end and electrically connecting with the bridge unit.

20 Claims, 7 Drawing Sheets

ELECTRIC TERMINAL CONNECTOR

BACKGROUND OF THE INVENTION

1. Field of the Invention

The present invention relates to an electric terminal connector. Particularly, the present invention relates to the electric terminal connector including a cap to securely fasten an end of at least one transmission line in a shell to electrically connect a coax connector with the transmission line for increasing the assembling reliability and providing a convenient use.

2. Description of the Related Art

Recently, owing to the improvement in the electronics technique, various video apparatuses and equipment, such as video camera, CCD camera etc., are quickly updated and widely made in use in our daily life. Because of the arrival of the Digital Age, the various video apparatuses and equipment have to transmit video data generated by themselves through transmission lines to some kind of electric devices, such as a computer, for restoring the video data and enabling a user to review. However, a coax connector is needed for the electrical connection between the transmission line and the electric device, so that the connection between the coax connector and the transmission line is emphatically important. In general operation, the conventional way to connect the coax connector with an end of the transmission line electrically and securely is soldering.

However, the functional disadvantage of the conventional way to electrically connect the coax connector and the transmission line is as the following. There are various standards of the coax connector for fitting numerous electric devices and therefore soldering the coax connector and the transmission line together make the transmission line unable to indirectly connect to electric devices through various coax connectors having different standards. Accordingly, there is a need for redesigning the heat-dissipating module in applying to the miniature electronic component.

As is described in greater detail below, the present invention intends to provide an electric terminal connector including a cap to bias at least one elastic reed for correspondingly and securely fastening an end of at least one transmission line on a bridge unit which is received in a shell and further connects with a coax connector. The bridge unit thereby electrically connects between the at least one transmission line and the coax connector. Consequently, the present invention improves the assembling reliability and provides a convenient use.

SUMMARY OF THE INVENTION

The primary objective of this invention is to provide an electric terminal connector including a cap to bias at least one elastic reed for correspondingly fastening an end of at least one transmission line on a bridge unit which is further connected with a coax connector. Accordingly, the assembling reliability is improved.

The secondary objective of this invention is to provide the electric terminal connector, with the elastic reed having a stop portion for accurately stopping the end of the transmission line at a side of the elastic reed for a convenient use.

The electric terminal connector in accordance with an aspect of the present invention includes a shell, a bridge unit, and a cap. The shell includes a compartment, a first end, a second end and at least one biasing member. The bridge unit is received in the compartment of the shell, which has a base and at least one elastic reed. The base securely mounted in the compartment, and the at least one elastic reed fastened on the base and extending to an area adjacent to the at least one biasing member respectively. The cap comprises a passageway, covers the first end of the shell, and presses the biasing member to protrude into the compartment of the shell to bias the elastic reed. Consequently, at least one transmission line passes through the passageway of the cap and is securely fastened between and electrically connects with the biased elastic reed and the base while a coax connector combines with the shell at the second end and electrically connecting with the bridge unit.

In a separate aspect of the present invention, the biasing member elastically switches between an initial state and a biasing state, with the biasing member extending outwardly from the outer circumference of the shell at the initial state and protruding into the compartment at the biasing state.

Further scope of the applicability of the present invention will become apparent from the detailed description given hereinafter. However, it should be understood that the detailed description and specific examples, while indicating preferred embodiments of the invention, are given by way of illustration only, since various will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
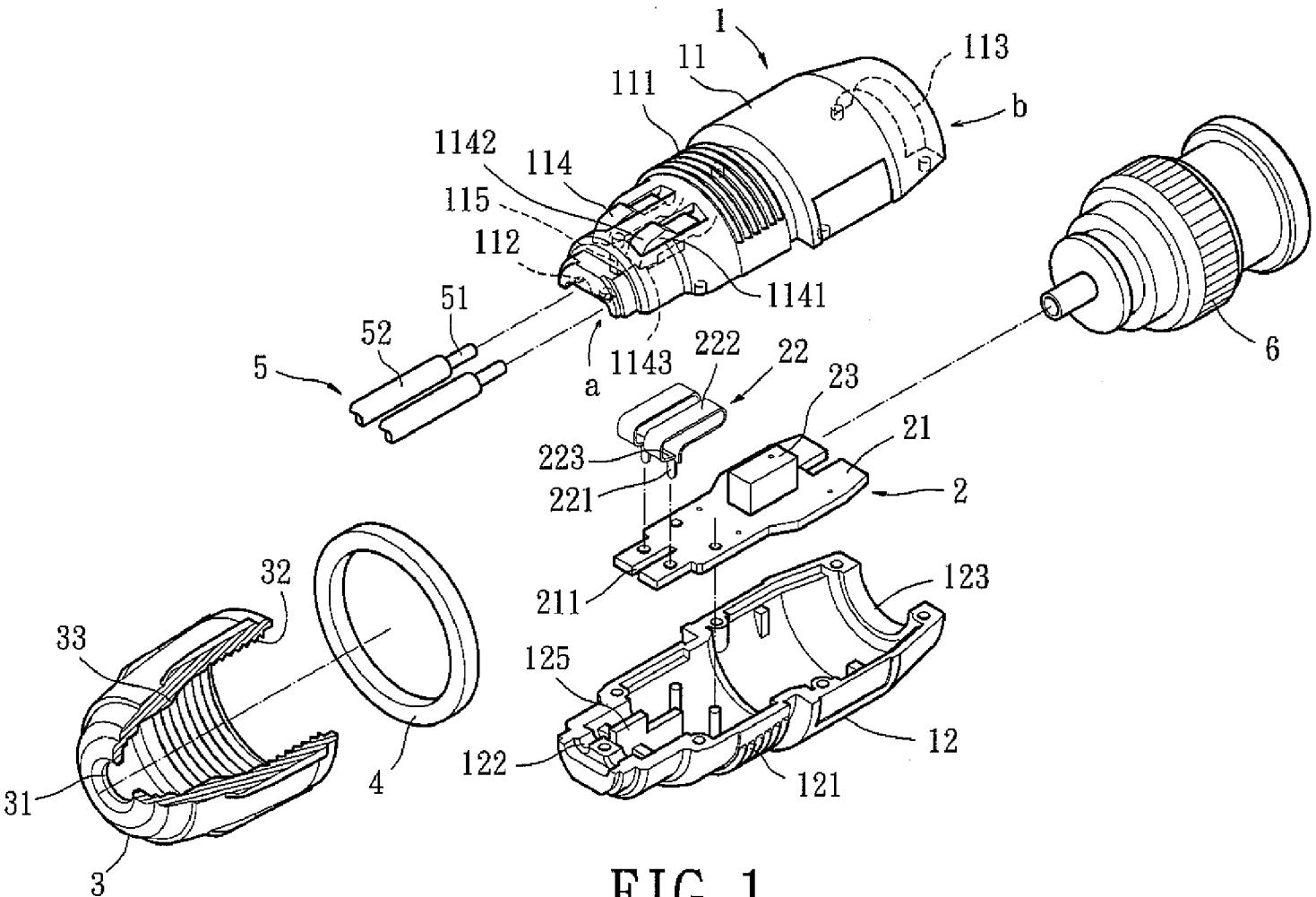
FIG. 1 is an exploded perspective view illustrating an electric terminal connector in accordance with a first embodiment of the present invention.

Referring now to FIG. 1, an exploded perspective view illustrating an electric terminal connector in accordance with a first embodiment of the present invention. In this preferred embodiment, the electric terminal connector includes a shell 1, a bridge unit 2, a cap 3 and a washer 4. The shell 1 forms a compartment (not labeled) for receiving the bridge unit 2. The cap 3 fixes to an end of the shell 1 for securely fastening an end of at least one transmission line 5 in the shell 1. The washer 4 is disposed between the shell 1 and the cap 3, so as to tightly fix the cap 3 on the shell 1. One end of the shell 1 connects with a coax connector 6, which extends into the shell 1 and electrically connects with the bridge unit 2. The transmission line 5 thereby electrically connects to the coax connector 6 through the bridge unit 2.

Constructions of the shell 1 shall be described in detail, with reference to FIG. 1. The shell 1 includes a first end a, a second end b, a first case 11 and a second case 12. The first and second ends a, b are disposed at two corresponding ends of the shell 1, wherein the first end a fixes with the cap 3 and the second end b connects with the coax connector 6. The first case 11 and second case 12 jointly form the shape of the shell 1 and the compartment. The first case 11 includes a first engaging portion 111, at least one first recess 112, a first connecting portion 113, at least one biasing member 114 and a first isolating portion 115 while the second case 12 includes a second engaging portion 121, at least one second recess 122, a second connecting portion 123 and a second isolating portion 125.

Figure 3:
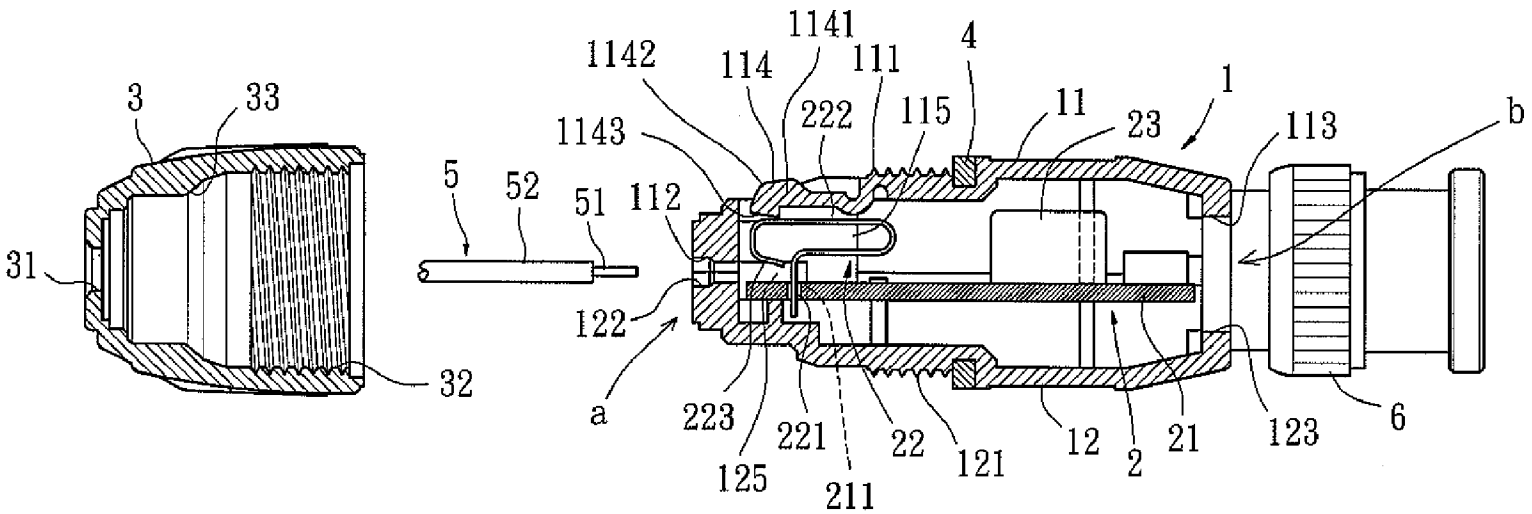
FIG. 3 is a cross-sectional side view illustrating an electric terminal connector in accordance with the first embodiment of the present invention.

With continued reference to FIG. 1 and further reference to FIG. 3, The first and second engaging portions 111, 121 are disposed on an outer circumference of the shell 1 and jointly form a first engaging member (not labeled). Preferably, the first engaging member is shaped into a thread. The first recess 112 and the second recess 122 jointly form a through hole (not labeled) at the first end a of the shell 1 for the transmission line 5 to pass through. The first and second connecting portions 113, 123 jointly form a connecting member (not labeled) at the second end b of the shell 1 for connecting and positioning the coax connector 6. The biasing member 114 extends outwardly from the outer circumference of the first case 11 and is able to be biased by an external force to protrude into the compartment of the shell 1, with the biasing member 114 automatically and elastically returning while the external force is removed. Preferably, the biasing member 114 is positioned adjacent to the first engaging portion 111. The isolating portions 115, 125 are substantially stretching to each other for pressing the bridge unit 2 from opposite sides so as to fasten the bridge unit 2 between the two isolating portions 115, 125. Preferably, at least one of the isolating portions 115, 125 provides a step portion (not labeled) to contact each other.

Constructions of the biasing member 114 shall be described in detail, with still reference to FIGS. 1 and 3. The biasing member 114 switches between an initial state and a biasing state, which includes a protrusion 1141, a contacted surface 1142 and a biasing surface 1143. The protrusion 1141 substantially extends outwardly from the outer circumference of the biasing member 114, preferably, which is integrally molded on the biasing member 114. The contacted surface 1142 locates at the outside of the protrusion 1141 such that a protrudent distance exists between the contacted surface 1142 and the adjacent outer circumference of the first case 11 at the initial state. The biasing surface 1143 is disposed on a side of the biasing member 114 opposite to the contacted surface 1142, namely the biasing surface 1143 facing the compartment of the shell 1. Alternatively, when an external force is enforced on the contacted surface 1142, the biasing member 114 is elastically deformed and switched into the biasing state, namely the protrudent distance being reduced and the biasing surface 1143 protruding into the compartment. As long as the external force is removed, the biasing member 114 returns back to the initial state automatically. Furthermore, the contacted surface 1142 of the biasing member 114 preferably is in a curve shape.

Figure 2:
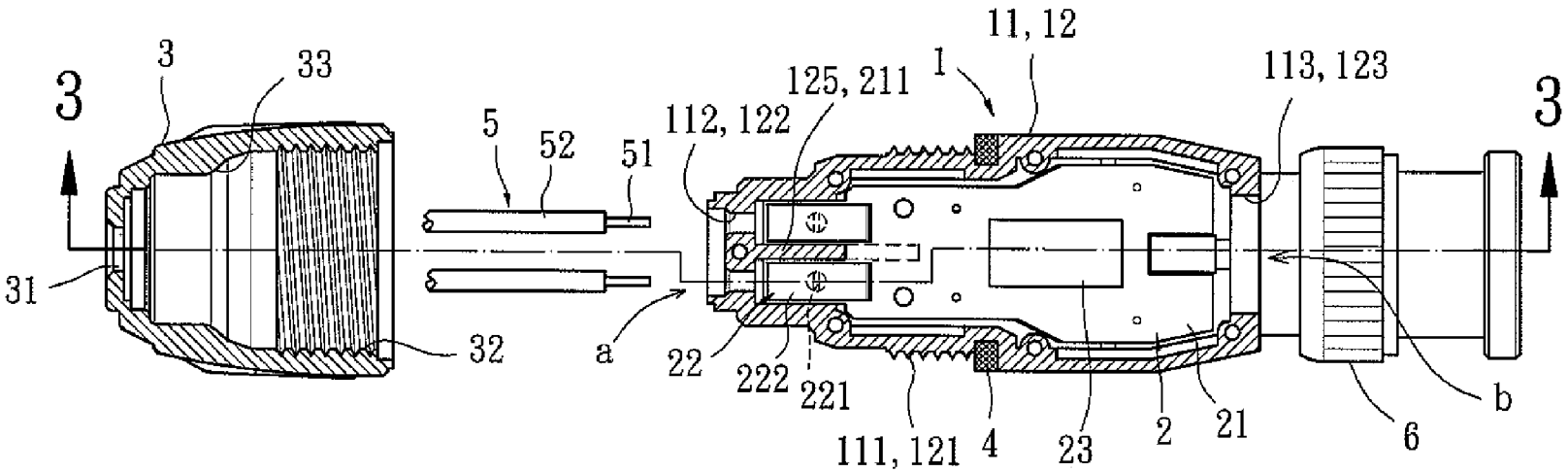
FIG. 2 is a cross-sectional top view illustrating an electric terminal connector in accordance with the first embodiment of the present invention.

With continued reference to FIGS. 1 to 3, the bridge unit 2 includes a base 21, at least one elastic reed 22 and an electronic device 23. The base 21 is arranged in the compartment of the shell 1, with at least a first surface (not labeled) thereof facing the inner circumference of the first case 11, and one end of the base 21 is fastened between the two isolating portions 115, 125. The elastic reed 22 is disposed on the first surface of the base 21 and can be pressed by the biasing member 114 to fasten the transmission line 5 on the bridge unit 2. Preferably, the elastic reed 22 is made of conductive materials for providing an electrical conductivity between the base 21 and the elastic reed 22. The electronic device 23 is provided on the base 21 as an impedance matching device. Particularly, the amounts of the biasing member 114, the through hole jointly formed by the first and second recesses 112, 122, the elastic reed 22, and the transmission line 5 are conformed to each other and selected as two in the illustrated embodiment. Furthermore, corresponding to the isolating portions 115, 125 of the shell 1, the base 21 further comprises a groove 211 for receiving the step portion. Thereby, a securely combination is provided, and an isolating partition is established through the combination of the isolating portions 115, 125 such that the inserted transmission lines 5 are certainly isolated.

Constructions of the elastic reed 22 shall be described in detail, with still reference to FIGS. 1 to 3. The elastic reed 22 comprises a stop portion 221, a pressed portion 222, and a connecting portion 223. The stop portion 221 electrically contacts the base 21 and protrudes with a predetermined length from and perpendicularly to the first surface of the base 21, so as to stop the transmission line 5. With linking the stop portion 221 and the connecting portion 223 by two opposite ends, the pressed portion 222 extends to an area adjacent to the contacted surface 1142 for receiving the pressure passed by the biasing member 114 and then moving toward the base 21. Moreover, the two ends of the pressed portion 222 separately shape two crooked structures (not labeled) for providing the elasticity of the elastic reed 22. Furthermore, a part of the pressed portion 222 disposed in the area adjacent to the contacted surface 1142 is parallel with the first surface of the base 21. The connecting portion 223 is spaced apart from the base 21 for the transmission line 5 to insert between the connecting portion 223 and the base 21.

Still referring to FIGS. 1 to 3, the cap 3 includes a passageway 31, a second engaging member 32, and a pressing surface 33. With being corresponding to the through hole jointly formed by the first recess 112 and the second recess 122, the passageway 31 is disposed at the top of the cap 3 for the transmission line 5 to pass through. On the inner circumference of the cap 3, the second engaging member 32 is disposed adjacent to the end edge of the cap 3 and is able to engage with the first engaging member of the shell 1. Moreover, for engaging with the thread jointly provided by the engaging portions 111, 121, the second engaging member 32 is preferably in a threaded shape. The pressing surface 33 is disposed on the inner circumference of the cap 3 between the passageway 31 and the second engaging member 32.

Preferably, the washer 4 is made of anti-slip materials to avoid the cap 3 disengaging from the shell 1. Furthermore, the washer 4 can be provided with various colors for a user to conveniently recognize the type of the transmission line 5 without disengaging the cap 3 from the shell 1. Otherwise, the transmission line 5 has a conductor 51 at the core thereof while the circumference of the conductor 51 is covered with an insulator 52.

Figure 4:
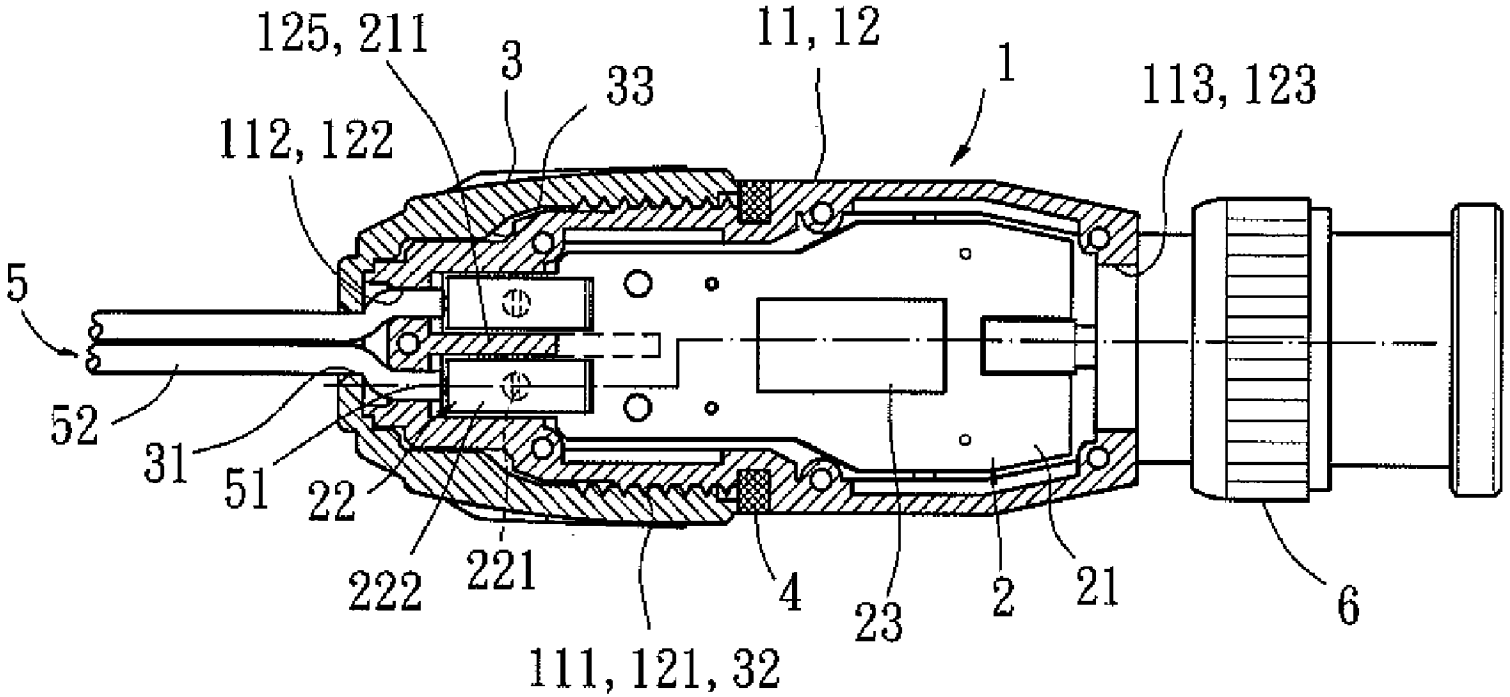
FIG. 4 is a cross-sectional top view illustrating an assembling operation in accordance with the first embodiment of the present invention.
Figure 5:
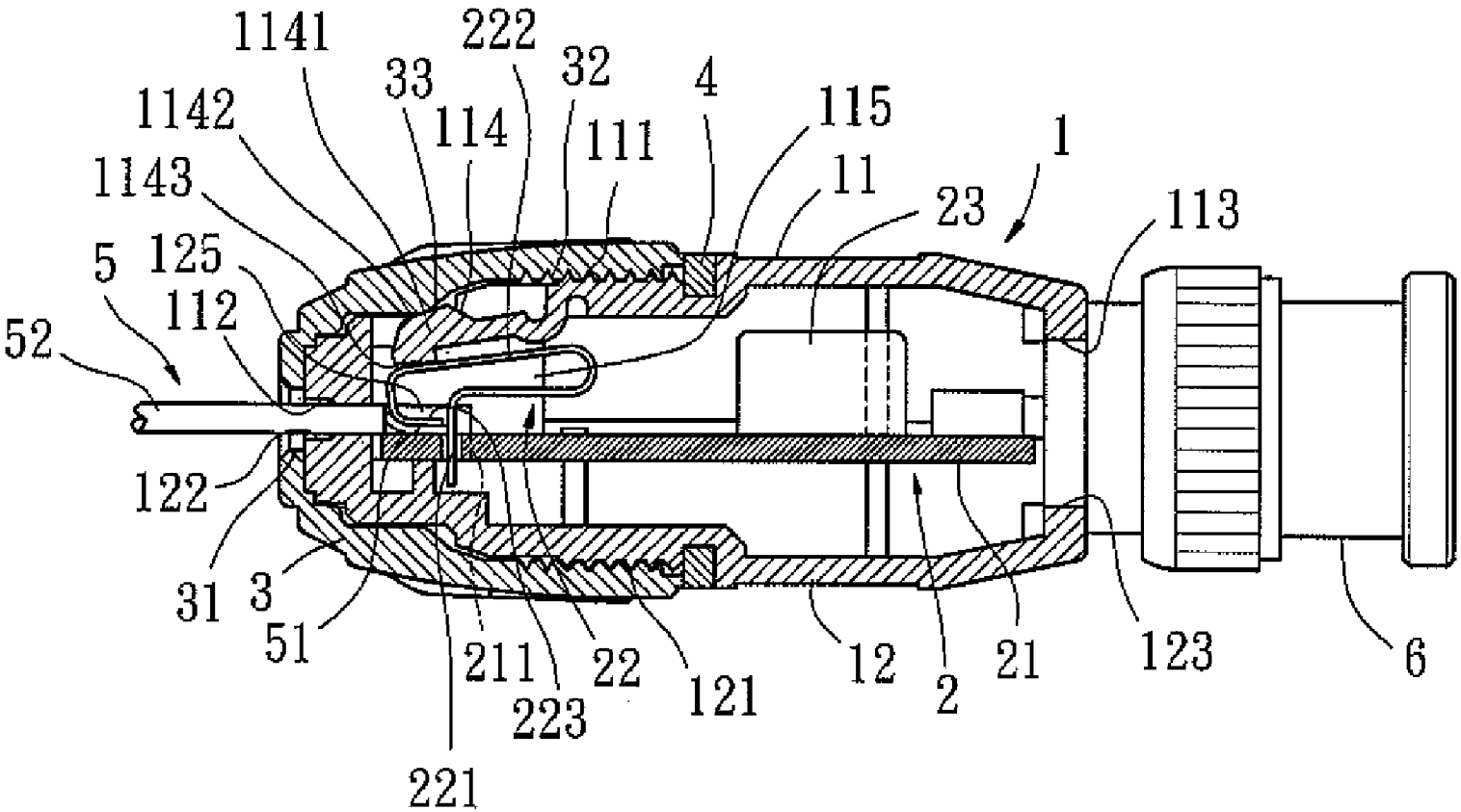
FIG. 5 is a cross-sectional side view illustrating an assembling operation in accordance with the first embodiment of the present invention.

Referring now to FIGS. 4 and 5, in assembling operation, as the first step, the first and second cases 11, 12 combine with each other for receiving and securely fastening the bridge unit 2 in the compartment while the coax connector 6 is positioned by the connecting member jointly formed by the two connecting portions 113, 123 and electrically connects with the bridge unit 2. At the meantime, the biasing member 114 is in the initial state with the protrudent distance existing between the contacted surface 1142 and the adjacent outer circumference of the first case 11. Furthermore, the connecting portion 223 is spaced apart from the base 21 to define a gap for the transmission line 5 to insert.

Next, The transmission line 5 passes through the passageway 31 and the through hole jointly formed by the recesses 111, 112 in sequence and inserts into the gap between the connecting portion 223 and the base 21; meanwhile, the stop portion 221 suitably stops the conductor 51 of the transmission line 5 to avoid an over insertion of the conductor 51, which may cause an undesired short circuit between the conductor 51 and the bridge unit 2. In the present embodiment, the two transmission lines 5 respectively pass through the two through holes and are insulated to each other by the isolating partition established by the isolating portions 115, 125.

Finally, when the cap 3 fixes on the shell 1, the pressing surface 33 presses the contacted surface 1142 of the biasing member 114, such that the biasing surface 1143 biases the pressed portion 222 and makes the connecting portion 223 move toward the base 21 to fasten the conductor 51. Moreover, in the present embodiment, preferably, the size of the passageway 31 of the cap 3 is appropriately suit to the transmission lines 5 so as to bundle the transmission lines 5 tightly. Thereby, the nearby areas of the passageway 31 and the through hole jointly formed by the recesses 111, 112 squeeze the transmission line 5 to be positioned securely and connect to the bridge unit 2 for sure.

Figure 6:
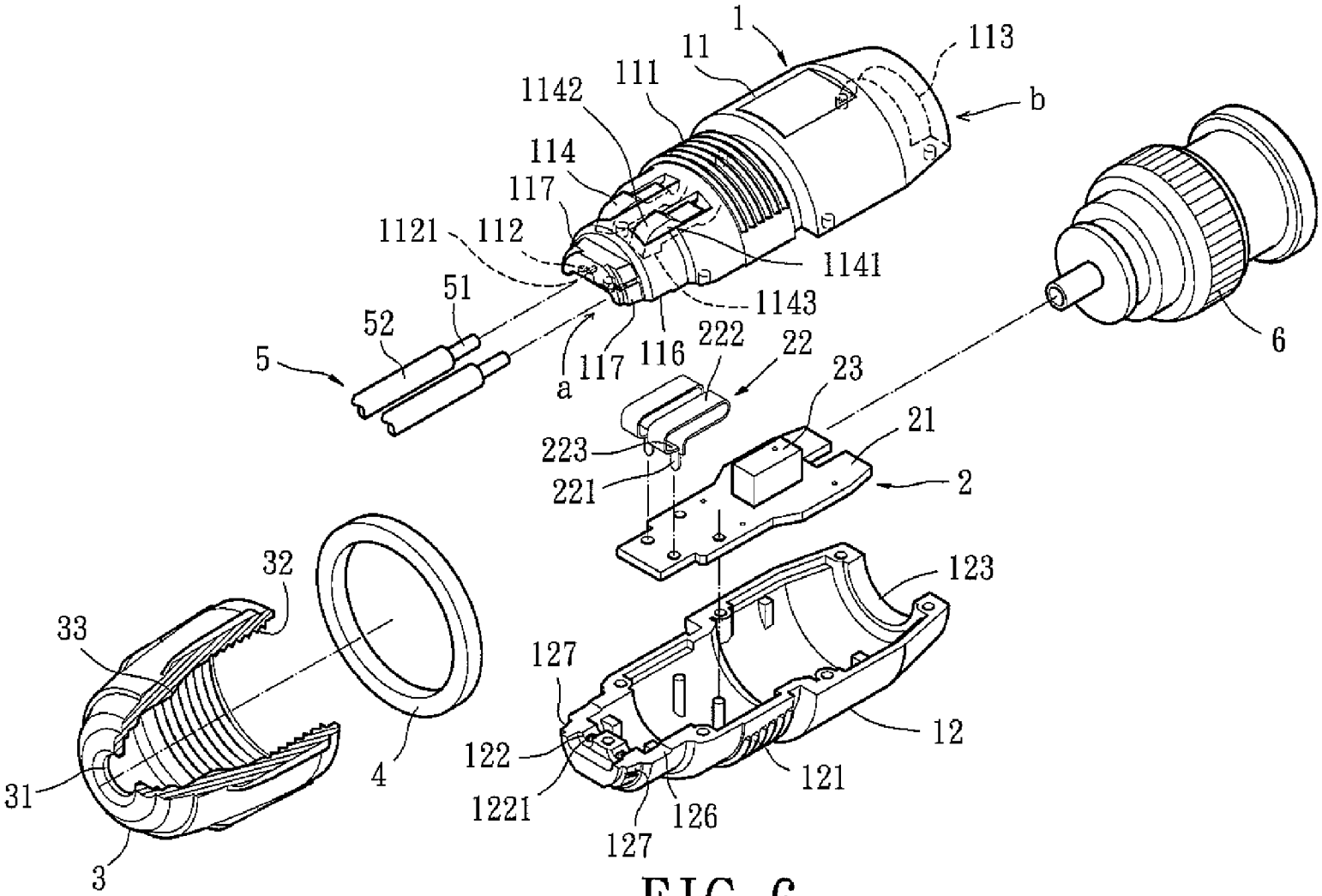
FIG. 6 is an exploded perspective view illustrating an electric terminal connector in accordance with a second embodiment of the present invention.
Figure 7:
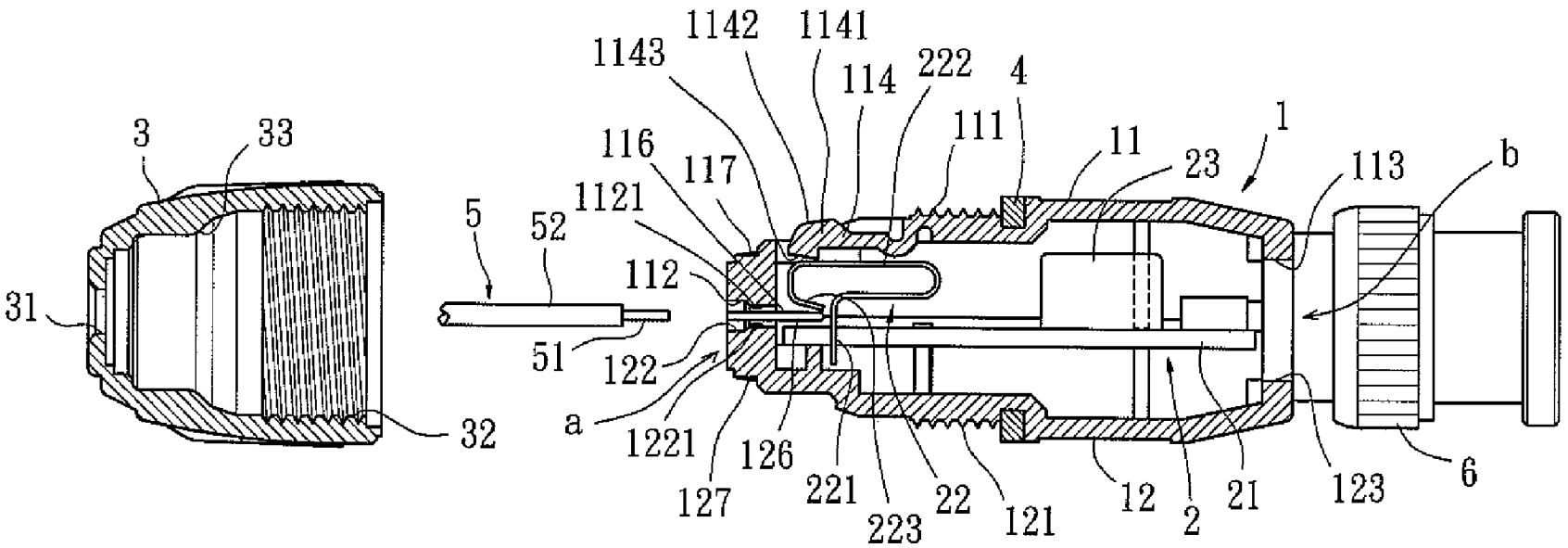
FIG. 7 is a cross-sectional side view illustrating an assembling operation in accordance with the second embodiment of the present invention.

Turning now to FIGS. 6 and 7, an exploded perspective view of an electric terminal connector in accordance with the second embodiment of the present invention is illustrated. In comparison with the first embodiment, the shell 1 omits the two isolating portions 115, 125 but adds at least one slit at the border between the first case 11 and the second case 12, wherein the slit is defined between a first notch 116 and a second notch 126 respectively disposed at edges of the first and second cases 11, 12, has an opening end at the first end a of the shell 1, and axially extends a distance toward the second end of the shell. Correspondingly, in-between the distance wherein the slit extending, a plurality of first ramps 117 and second ramps 127 are separately disposed on the out circumferences of the first and second cases 11, 12 and arranged adjacent to the first end a of the shell 1. Alternatively, the first ramps 117 may be integrated into one piece while the second ramps 127 may also be integrated into one piece. Moreover, the recesses 112, 122 further comprise a plurality of lumps 1121, 1221 on the inner circumferences thereof respectively.

When the combining process between the shell 1 and cap 3 is executed, the inner circumference of the cap 3 presses the ramps 117, 127, and therefore the slit formed by the notches 116, 117 is compressed and the lumps 1121, 1221 tightly fasten the transmission line 5 through the insulator 52.

As has been discussed above, the conventional way to electrically connect the coax connector and the transmission line by soldering makes the transmission line unable to indirectly connect to electric devices through various coax connectors with different standards. Conversely, the cap 3 of the present invention is designed to bias the elastic reed 22 for correspondingly and securely fastening an end of the transmission line 5 on the bridge unit 2, wherein the bridge unit 2 is received in the shell 1 and electrically connects between the transmission line 5 and the coax connector 6. Consequently, the present invention improves the assembling reliability and provides a convenient use.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. An electric element connector, comprising:

a shell providing a compartment, a first end, a second end and at least one biasing member;

a bridge unit received in the compartment of the shell, having a base and at least one elastic reed, wherein the base securely mounts in the compartment, and the at least one elastic reed is fastened on the base and respectively extends to an area adjacent to the at least one biasing member; and a cap forming a passageway, covering the first end of the shell, and pressing the biasing member to protrude into the compartment of the shell, with the pressed biasing member biasing the elastic reed;

wherein the passageway of the cap is utilized for at least one transmission line to pass through, and the transmission line is securely fastened between the elastic reed and the base for electrically connecting with the base;

wherein a coax connector combines with the shell at the second end and electrically connects with the bridge unit.

2. The electric terminal connector as defined in claim 1, wherein the biasing member comprises a protrusion extending outwardly from an outer circumference of the biasing member, a contacted surface locating at an outside of the protrusion, and a biasing surface forming on one side of the biasing member opposite to the contacted surface to face the compartment of the shell.

3. The electric terminal connector as defined in claim 1, wherein the contacted surface of the biasing member is in a curve shape.

4. The electric terminal connector as defined in claim 1, further comprising a washer between the shell and the cap to avoid the cap disengaging from the shell.

5. The electric terminal connector as defined in claim 1, wherein the cap further forms a pressing surface to press the biasing member.

6. The electric terminal connector as defined in claim 1, wherein the biasing member elastically switches between an initial state and a biasing state, with the biasing member extending outwardly from an outer circumference of the shell at the initial state and protruding into the compartment at the biasing state.

7. The electric terminal connector as defined in claim 6, wherein the biasing member comprises a protrusion extending outwardly from the outer circumference of the biasing member, a contacted surface locating at an outside of the protrusion, and a biasing surface forming on one side of the biasing member opposite to the contacted surface to face the compartment of the shell, with a protrudent distance existing between the contacted surface and an adjacent outer circumference of the shell at the initial state.

8. The electric terminal connector as defined in claim 1, wherein the shell is jointly formed by a first case and a second case with the first case providing the biasing member.

9. The electric terminal connector as defined in claim 8, wherein the elastic reed is arranged on a surface of the base with the surface facing an inner circumference of the first case.

10. The electric terminal connector as defined in claim 8, wherein the first case provides at least one first recess while the second case provides at least one second recess with the first and second recesses jointly and correspondingly forming at least one through hole at the first end of the shell.

11. The electric terminal connector as defined in claim 8, wherein the first case provides a first connecting portion while the second case provides a second connecting portion with the first and second connecting portions jointly forming a connecting member to combine the coax connector with the shell.

12. The electric terminal connector as defined in claim 8, wherein the first case provides a first engaging portion while the second case provides a second engaging portion with the first and second engaging portions jointly forming a first engaging member, with the cap having a second engaging member to engage with the first engaging member.

13. The electric terminal connector as defined in claim 8, wherein the first case provides at least one first notch while the second case provides at least one second notch with the first and second notches jointly forming at least one slit having an opening end at the first end of the shell and extending a distance toward the second end of the shell, with at least one ramp disposed in-between the distance and on an outer circumference of the shell.

14. The electric terminal connector as defined in claim 1, wherein the elastic reed comprises a stop portion electrically contacting the base, a pressed portion passes through the area adjacent to the contacted surface, and a connecting portion electrically connecting with the transmission line.

15. The electric terminal connector as defined in claim 14, wherein the stop portion protrudes with a predetermined length from a surface of the base where the base contacts the stop portion.

16. The electric terminal connector as defined in claim 14, wherein a part of the pressed portion disposed in the area is parallel with a surface of the base where the base contacts the stop portion.

17. The electric terminal connector as defined in claim 14, wherein the pressed portion links the stop portion and the connecting portion by two opposite ends thereof.

18. The electric terminal connector as defined in claim 17, wherein the two opposite ends of the pressed portion shape two crooked structures for providing the elasticity of the elastic reed.

19. The electric terminal connector as defined in claim 8, wherein the first case provides a first isolating portion while the second case provides a second isolating portion with the first and second isolating portions jointly forming an isolating partition at the first end of the shell.

20. The electric terminal connector as defined in claim 19, wherein the base further forms a groove corresponding to and partially receiving the isolating partition.

* * * * *